US012110618B2

(12) United States Patent
Takumi et al.

(10) Patent No.: US 12,110,618 B2
(45) Date of Patent: Oct. 8, 2024

(54) KNITTED FABRIC STRUCTURE, SOCKS, ARM COVER, LEGGINGS, AND SHIRT

(71) Applicant: Murata Manufacturing Co., Ltd., Nagaokakyo (JP)

(72) Inventors: Kenichiro Takumi, Nagaokakyo (JP); Ryosuke Ebina, Osaka (JP); Tsuyoshi Soeda, Osaka (JP); Masayuki Tsuji, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 0 days.

(21) Appl. No.: 18/087,144

(22) Filed: Dec. 22, 2022

(65) Prior Publication Data

US 2023/0250562 A1 Aug. 10, 2023

(30) Foreign Application Priority Data

Feb. 4, 2022 (JP) ..... 2022-016607

(51) Int. Cl.
*D04B 1/24* (2006.01)
*D04B 1/12* (2006.01)
*D04B 1/18* (2006.01)

(52) U.S. Cl.
CPC ..... *D04B 1/24* (2013.01); *D04B 1/12* (2013.01); *D04B 1/18* (2013.01); *D10B 2401/18* (2013.01);
(Continued)

(58) Field of Classification Search
CPC ..... D04B 1/16; D04B 1/24; D04B 1/12; D04B 1/18; D10B 2401/18; D10B 2501/02; D10B 2501/043; D10B 2331/041; D10B 2401/16; D10B 2401/13; D03D 1/00; D03D 1/0088; D03D 15/00; D03D 15/283; D03D 15/50; H02N 2/18; H02N 2/02; H04R 17/005; H04R 17/00; H10N 30/098; H10N 30/1061; H10N 30/20; H10N 30/30; H10N 30/302; H10N 30/857; H10N 30/877; H10N 30/1071
See application file for complete search history.

(56) References Cited

U.S. PATENT DOCUMENTS 10,447,178 B1 * 10/2019 Hays ..... A45C 3/06
2018/0108826 A1 * 4/2018 Tajitsu ..... G01L 1/16
(Continued)

FOREIGN PATENT DOCUMENTS

CN 105200552 A * 12/2015
JP 6292368 B1 3/2018
(Continued)

OTHER PUBLICATIONS

Machine Translation of KR20160112896 (Year: 2016).*
(Continued)

*Primary Examiner* — Jennifer A Steele
(74) *Attorney, Agent, or Firm* — ArentFox Schiff LLP

(57) ABSTRACT

A knitted fabric structure that includes a piezoelectric yarn having a piezoelectric material that produces a surface potential by input of an external force from an outside of the piezoelectric yarn; and an elastic yarn having stretchability knitted together with the piezoelectric yarn, wherein the piezoelectric yarn has a mixing ratio of 5% or more based on a whole of the knitted fabric structure.

17 Claims, 10 Drawing Sheets

A

(52) U.S. Cl.
CPC .... *D10B 2501/02* (2013.01); *D10B 2501/043* (2013.01)

(56) References Cited

U.S. PATENT DOCUMENTS

| | | | | |
|---|---|---|---|---|
| 2019/0038787 | A1 | 2/2019 | Ando | |
| 2019/0078239 | A1* | 3/2019 | Ando | A01N 37/36 |
| 2019/0281820 | A1* | 9/2019 | Usui | A01N 37/02 |

FOREIGN PATENT DOCUMENTS

| | | | | |
|---|---|---|---|---|
| JP | 6428979 | B1 | 11/2018 | |
| JP | 6922546 | B2 | 8/2021 | |
| JP | 2022161847 | A | 10/2022 | |
| KR | 20160112896 | A * | 9/2016 | A41B 11/14 |
| WO | 2017212836 | A1 | 12/2017 | |
| WO | 2022215672 | A1 | 10/2022 | |

OTHER PUBLICATIONS

Wang "Study of Properties of Medical Compression Fabric" Journal of Fiber Bioengineering & Informatics 4:1 (2011) 15-22; http://www.jbi.org (Year: 2011).*

* cited by examiner

KNITTED FABRIC STRUCTURE, SOCKS, ARM COVER, LEGGINGS, AND SHIRT

CROSS REFERENCE TO RELATED APPLICATIONS

This application claims priority to Japanese Patent Application No. 2022-016607 filed on Feb. 4, 2022, the entire contents of which are incorporated by reference herein.

BACKGROUND OF THE INVENTION

Field of the Invention

The present disclosure relates to a knitted fabric structure, socks, an arm cover, leggings, and a shirt.

Description of the Related Art

Conventionally, socks using piezoelectric fibers have been disclosed (WO-A-2017/212836). Furthermore, WO-A-2017/212836 also discloses that socks (or supporters) stretch along joints by movement during walking and produce electric charges in piezoelectric yarns to suppress proliferation of microbes.

SUMMARY OF THE INVENTION

Although the socks disclosed in WO-A-2017/212836 also have a reasonable effect of suppressing proliferation of microbes, the need for a knitted fabric structure that suppresses proliferation of microbes has been increasing, and there is room for further improvement in reality.

Therefore, an object of the present disclosure is to provide a knitted fabric structure, socks, an arm cover, leggings, and a shirt capable of suppressing proliferation of microbes.

The inventors of the present application have tried to solve the above problems by addressing in a new direction instead of addressing in an extension of the prior art. Specifically, attention has been paid to the fact that a "yarn comprising an electric field producing filament" produces an electric potential by receiving energy (such as tension and stress) from the outside and producing an electric field, and for example, an antibacterial action or the like is exerted by such an electric potential.

A knitted fabric structure of the present disclosure comprises: a piezoelectric yarn comprising a piezoelectric material that produces a surface potential by input of external force from an outside of the piezoelectric yarn; and an elastic yarn having stretchability knitted together with the piezoelectric yarn, wherein the piezoelectric yarn has a mixing ratio of 5% or more based on a whole of the knitted fabric structure.

Socks of the present disclosure include the knitted fabric structure of the present disclosure described above. Leggings of the present disclosure include the knitted fabric structure of the present disclosure described above. An arm cover of the present disclosure includes the knitted fabric structure of the present disclosure described above. A shirt of the present disclosure includes the knitted fabric structure of the present disclosure described above.

With the present disclosure, it is possible to provide a knitted fabric structure, socks, an arm cover, leggings, and a shirt capable of suppressing proliferation of microbes. Note that the effects described in the present specification are merely examples and are not limited, and additional effects may be provided.

DETAILED DESCRIPTION OF THE INVENTION

A knitted fabric structure, socks, an arm cover, leggings, and a shirt of the present disclosure are described below. Although the description will be made with reference to the drawings as necessary, the illustrated contents are only schematically and exemplarily illustrated for the understanding of the present disclosure, and the appearance, the dimensional ratio, and the like may be different from the actual ones. Note that various numerical ranges mentioned in the present specification are intended to include the lower limit and/or the upper limit themselves unless otherwise specified. That is, when a numerical range such as 1 to 10 is taken as an example, it can be interpreted as including the lower limit value of "1" and also including the upper limit value of "10". In addition, although the term "about" or "degree" may be added to various numerical values, the terms "about" and "degree" mean that variations of several percent, such as ±10%, ±5%, ±3%, ±2%, ±1%, can be included.

Figure 1:
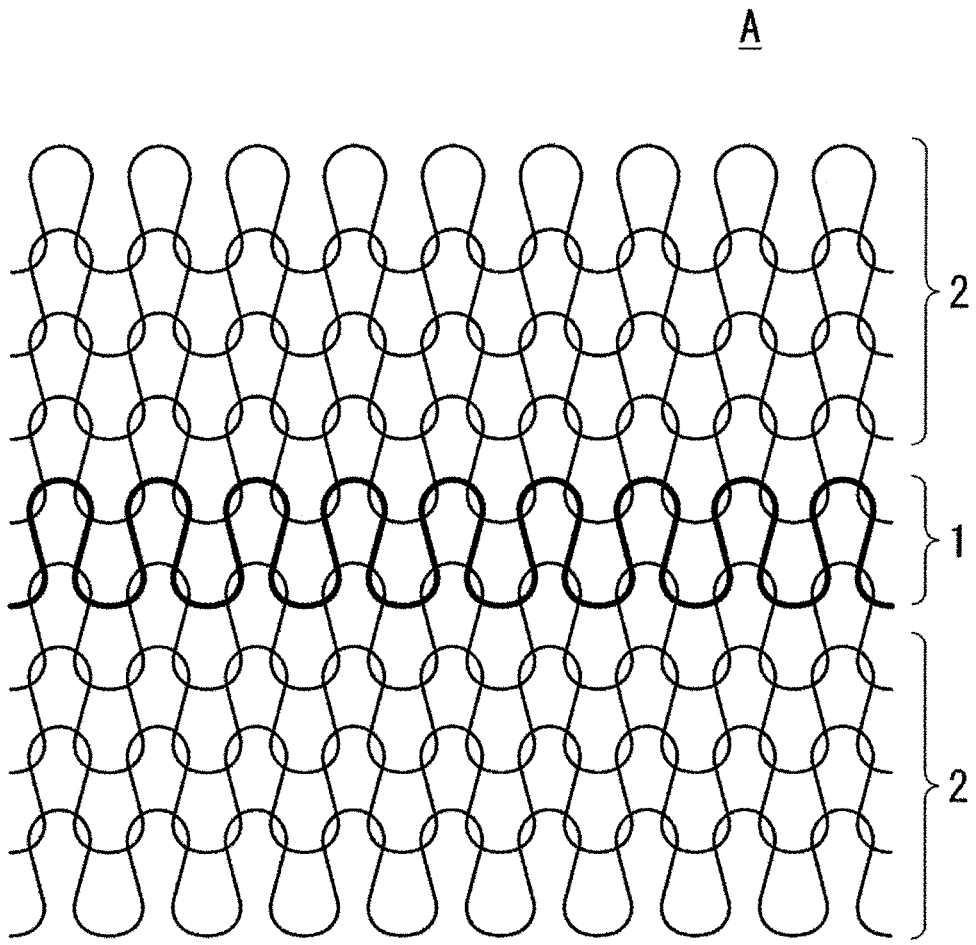
FIG. 1 schematically shows a knitted fabric structure of the present disclosure.

For example, a knitted fabric structure A of the present disclosure includes a piezoelectric yarn 1 that includes a piezoelectric polymer and produces a surface potential by input of energy from the outside of the piezoelectric yarn, and an elastic yarn 2 having stretchability as shown in FIG. 1. Here, the term "knitted fabric" used in the present specification means a sheet-like structure having a weave formed by connecting a plurality of loops to each other, that is, a knit structure. For example, a knitted item can be knitted by forming a loop (such as a ring-shaped portion) of the yarn and hooking the next loop on the loop to form a surface or weave by continuing this operation. The knitted item may more specifically have a weave that can be formed by knitting such as weft knitting, warp knitting, circular knitting, tubular knitting, and socks knitting. Such knitted fabrics also include tricot, raschel, and the like. The knitted fabric of the present disclosure also includes sewn products such as a cut and sew and a knitted and sewn product. Furthermore, a seamless product such as WHOLEGARMENT is also included in the knitted fabric of the present disclosure (WHOLEGARMENT (registered trademark)). That is, it is a concept clearly different from a woven fabric in which the warp and the weft intersect with each other at a right angle to form a fabric.

Examples of the weave that can be included in the knitted fabric of the present disclosure include, but are not limited to, a weave such as jersey stitch (also referred to as plain stitch or stockinette stitch), spandex jersey stitch, plating jersey stitch, smooth stitch (also referred to as interlock stitch), moss stitch (front moss stitch and back moss stitch), knit-miss stitch (also referred to as float stitch), honeycomb stitch, thermal stitch (also referred to as waffle stitch), and rib stitch. The weave may be different between the front and back of the knitted fabric. The weave may also include a "tuck". That is, tuck stitch may be used in combination. The weave may include a "miss" stitch. The knitted fabric may have a pile or a nap on the back surface. The touch, air permeability, stretchability, and the like of the cloth can change depending on the weave.

In the present disclosure, a weave including repeating minimal units of "knit", optionally "tuck" and/or "miss", is referred to as a "weave repeat".

Such a weave may be formed using a knitting machine or may be formed by hand knitting. When using a knitting machine, the type is not particularly limited, and a conventionally known knitting machine can be used without particular limitation.

Piezoelectric Yarn

First, the piezoelectric yarn 1 will be described with reference to FIGS. 2A to 4C. The piezoelectric yarn 1 includes "electric field producing filaments 10" (or fibers capable of producing an electric field by surface charge). The number of the electric field producing filaments 10 is not particularly limited, and for example, 2 or more, 2 to 500, preferably 10 to 350, more preferably about 20 to 200 electric field producing filaments may be included in the yarn of the present disclosure.

In the present disclosure, the "electric field producing filament" basically means a "fiber (filament) capable of producing electric charge by energy from the outside (for example, tension and/or stress, etc.) to produce an electric potential (specifically, a surface potential) and/or electric field" as described above (hereinafter it may be referred to as a "potential producing fiber", a "potential producing filament", an "electric field producing fiber", a "charge producing fiber", or a "charge producing filament"). As the electric field producing filament, for example, a charge producing fiber described in JP-B-6428979 or the like may be used. The term "potential producing filament" can be used substantially synonymously with "electric field producing filament".

Examples of the "energy from the outside" include force from the outside (hereinafter may be referred to as "external force"), specifically the force that causes deformation or distortion of the piezoelectric yarn 1 or the electric field producing filaments 10 and/or the force applied in the axial direction of the piezoelectric yarn 1 or the electric field producing filaments 10, more specifically, external force such as tension (such as tensile force in the axial direction of the piezoelectric yarn 1 or the electric field producing filaments 10) and/or a stress (a tensile stress or a tensile strain applied to the piezoelectric yarn 1 or the electric field producing filaments 10) and/or external force such as the force applied in the transverse direction of the piezoelectric yarn 1 or the electric field producing filaments 10.

In the piezoelectric yarn 1, a surface potential produced by application of external force may be, for example, 0.1 V or more, preferably 1.0 V or more (both positive and negative potentials can be produced). When the surface potential is 0.1 V or more, proliferation of microbes can be suppressed in the knitted fabric structure A of the present disclosure. Here, the method for measuring the surface potential is not particularly limited, and the surface potential can be measured using, for example, a scanning probe microscope. In addition, it may have a direct bactericidal/virucidal action by the surface potential or may have an action caused by producing an electric potential opposite to the electric potential of microbes such as bacteria and fungi and viruses, thereby keeping microbes and viruses away.

The dimension (length, thickness (diameter), and the like) and the shape (cross-sectional shape and the like) of the electric field producing filaments 10 are not particularly limited. The piezoelectric yarn 1 including such electric field producing filaments 10 may include a plurality of electric field producing filaments 10 having different thicknesses. Therefore, the diameter of the piezoelectric yarn 1 may or may not be uniform in the length direction.

The electric field producing filaments 10 may be filaments or staple fibers. The electric field producing filaments 10 may have lengths (dimensions) of, for example, 0.01 mm or more. The lengths may be appropriately selected according to a desired use.

The thicknesses (diameters) of the electric field producing filaments 10 are not particularly limited and may be the same (uniform) or may not be the same along the length of the electric field producing filaments 10. The electric field producing filaments 10 may have thicknesses of, for example, 0.001 μm (1 nm) to 1 mm. The thicknesses may be appropriately selected according to a desired use.

Furthermore, the fiber strength of the piezoelectric yarn 1 is preferably 1 to 10 cN/dtex. Thus, the piezoelectric yarn 1 can withstand even larger deformation due to production of a high electric potential without breaking. The fiber strength is more preferably 1 to 7 cN/dtex, most preferably 1 to 5 cN/dtex. For the same purpose, the elongation of the piezoelectric yarn 1 is preferably 10 to 50%.

The shape of the electric field producing filaments 10, particularly the cross-sectional shape, is not particularly limited but may have, for example, a circular, elliptical, rectangular, or modified cross section. It is preferable to have a circular cross-sectional shape.

The electric field producing filaments 10 preferably include, for example, a material (hereinafter may be referred to as a "piezoelectric material" or a "piezoelectric body") having a piezoelectric effect (polarization phenomenon by external force) or piezoelectricity (the property of generating a voltage when a mechanical strain is applied or, conversely, generating a mechanical strain when a voltage is applied). Among them, it is particularly preferable to use fibers (hereinafter may be referred to as "piezoelectric fibers") including a piezoelectric material. Since piezoelectric fibers can produce an electric field by piezoelectricity, a power supply is unnecessary, and there is no risk of electric shock. The life of the piezoelectric material included in the piezoelectric fibers lasts longer than, for example, the antibacterial effect of a chemical agent or the like. Such piezoelectric fibers are less likely to cause allergic reactions.

The "piezoelectric material" can be used without particular limitation as long as it is a material having a piezoelectric effect or piezoelectricity and may be an inorganic material such as a piezoelectric ceramic or an organic material such as a polymer.

The "piezoelectric material" (or "piezoelectric fibers") preferably includes a "piezoelectric polymer". Examples of the "piezoelectric polymer" include a "piezoelectric polymer having pyroelectricity" and a "piezoelectric polymer having no pyroelectricity".

The "piezoelectric polymer having pyroelectricity" generally means a piezoelectric material made of a polymeric material that has pyroelectricity and can also produce electric charges (or electric potentials) on its surface simply by changing the temperature. Examples of such a piezoelectric polymer include polyvinylidene fluoride (PVDF). In particular, one that can produce electric charges (or electric potentials) on the surface thereof by thermal energy of the human body is preferable.

The "piezoelectric polymer having no pyroelectricity" generally means a piezoelectric polymer made of a polymeric material and excluding the "piezoelectric polymer having pyroelectricity" described above. Examples of such a piezoelectric polymer include polylactic acid (PLA). As the polylactic acid, poly-L-lactic acid (PLLA) obtained by polymerizing L-form monomers, poly-D-lactic acid (PDLA) obtained by polymerizing D-form monomers, and the like are known.

The piezoelectric yarn 1 may have such a configuration of the electric field producing filament 10 (or the charge producing fiber) that a conductor is used as a core yarn, an insulator is wound around (covers) the conductor, and an electric charge is produced by application of a voltage to the conductor.

The piezoelectric yarn 1 may be a yarn obtained by simply aligning a plurality of electric field producing filaments 10 (a paralleled yarn or a non-twisted yarn), may be a yarn that has been twisted (a twisted yarn or a twist yarn), may be a yarn that has been crimped (a crimped yarn or a false-twisted yarn), or may be a yarn that has been spun (a spun yarn). The yarn twisting method, crimping method, and spinning method are not particularly limited, and conventionally known methods can be used.

Figure 2A:
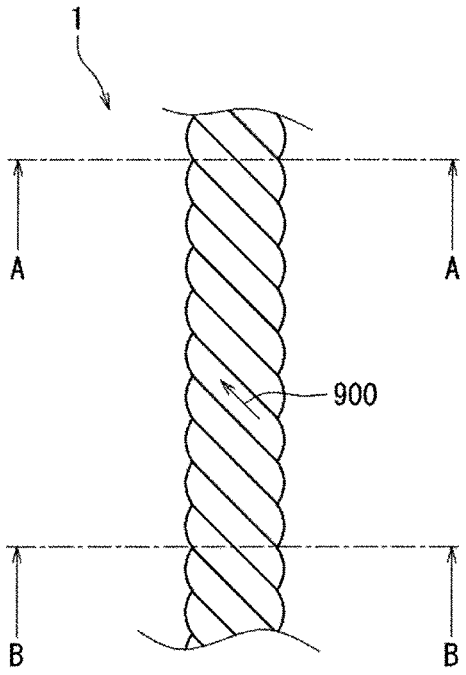
FIG. 2A shows a configuration of a yarn 1 (S yarn)

For example, as illustrated in FIG. 2A, the piezoelectric yarn 1 can also be configured by twisting a plurality of electric field producing filaments 10. The piezoelectric yarn 1 is a leftward spiraled yarn (hereinafter referred to as an "S yarn") in which the electric field producing filaments 10 are spiraled leftward in the aspect shown in FIG. 2A but may be a rightward spiraled yarn (hereinafter referred to as a "Z yarn") in which the electric field producing filaments 10 are spiraled rightward (see, for example, a piezoelectric yarn 1' in FIG. 4A). Thus, in the case of a twisted yarn, the piezoelectric yarn 1 may be either an "S yarn" or a "Z yarn".

In the piezoelectric yarn 1, the interval between the electric field producing filaments 10 is about 0 μm to about 10 μm, generally about 5 μm. The case where the interval between the electric field producing filaments 10 is 0 μm indicates that the electric field producing filaments are in contact with each other.

Hereinafter, in order to describe the piezoelectric yarn 1 in detail, an example of the piezoelectric yarn 1 will be described in more detail with reference to FIGS. 2A to 4C by exemplifying an aspect in which a piezoelectric material is included as the electric field producing filaments 10 and is "polylactic acid".

Polylactic acid (PLA) that can be used as the piezoelectric material is a chiral polymer and has a main chain with a helical structure. Polylactic acid can exhibit piezoelectricity when molecules are oriented by uniaxial drawing. When heat treatment is further performed to increase the degree of crystallization, the piezoelectric constant increases. By increasing the degree of crystallization as described above, the value of the surface potential can be improved.

The optical purity (enantiomeric excess (e.e.)) of polylactic acid (PLA) can be calculated by the following equation.

$$\text{Optical purity (\%)}=\{|\text{L-form amount}-\text{D-form amount}|/(\text{L-form amount}+\text{D-form amount})\}\times 100$$

For example, in both of the D-form and the L-form, the optical purity is 90 wt % or more, preferably 95 wt % or more, more preferably 98 wt % to 100 wt %, still more preferably 99.0 wt % to 100 wt %, particularly preferably 99.0 wt % to 99.8 wt %. As the L-form amount and the D-form amount of polylactic acid (PLA), for example, values obtained by a method using high performance liquid chromatography (HPLC) can be used.

As illustrated in FIG. 2A, the electric field producing filaments (or piezoelectric fibers) 10 including uniaxially drawn polylactic acid have tensor components d14 and d25 as piezoelectric strain constants when a thickness direction is defined as a first axis, a drawing direction 900 is defined as a third axis, and a direction orthogonal to both the first axis and the third axis is defined as a second axis.

Therefore, polylactic acid can produce an electric charge (or electric potential) most efficiently when distortion occurs in a direction of 45 degrees with respect to the direction of uniaxial drawing.

The number average molecular weight (Mn) of polylactic acid is, for example, $6.2\times10^4$, and the weight average molecular weight (Mw) is, for example, $1.5\times10^5$. The molecular weights are not limited to these values.

Figure 3A:
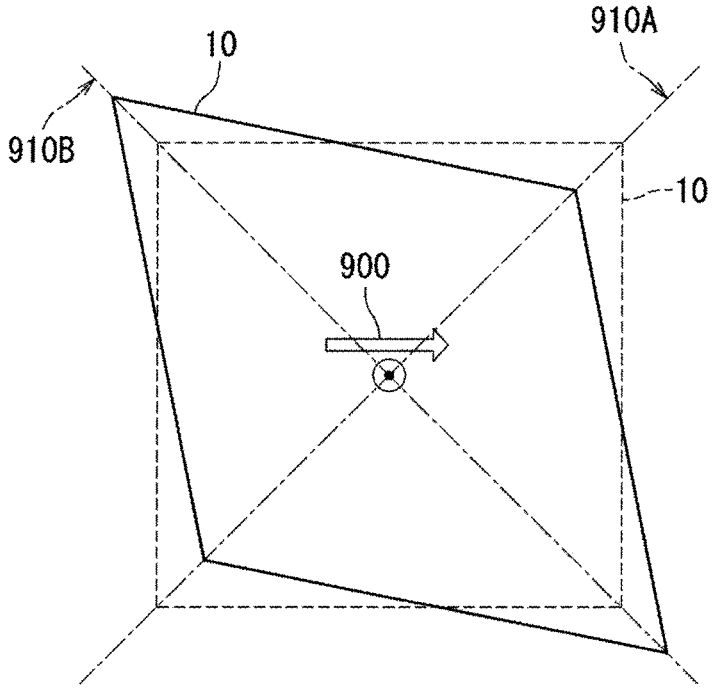
FIGS. 3A and 3B show the relationship among the uniaxial drawing direction of polylactic acid, the electric field direction, and the deformation of an electric field producing filament.
Figure 3B:
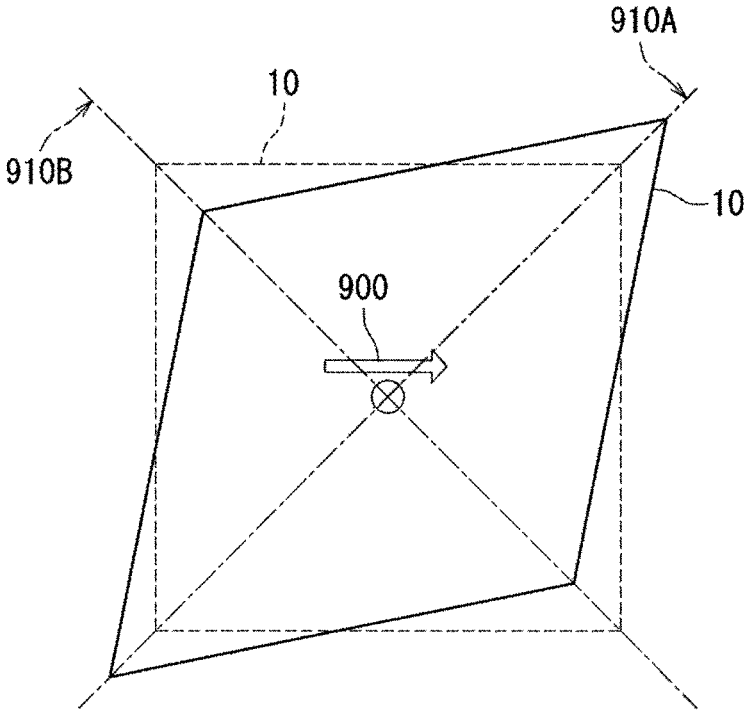

FIGS. 3A and 3B show the relationship among the uniaxial drawing direction of polylactic acid, the electric field direction, and the deformation of fiber including the electric field producing filament 10 and/or the piezoelectric yarn 1.

As illustrated in FIG. 3A, when the electric field producing filament 10 contracts in the direction of a first diagonal line 910A and expands in the direction of a second diagonal line 910B orthogonal to the first diagonal line 910A, an electric field can be produced in a direction from the back side to the front side of the plane of the drawing. That is, the electric field producing filament 10 can produce a negative charge on the front side of the plane of the drawing. As illustrated in FIG. 3B, the electric field producing filament 10 can produce an electric charge (or electric potential) even when expanding in the direction of the first diagonal line 910A and contracting in the direction of the second diagonal line 910B, but the polarity is reversed, and an electric field can be produced in a direction from the front to the back side of the plane of the drawing. That is, the electric field producing filament 10 can produce a positive charge on the front side of the plane of the drawing.

Since polylactic acid can have piezoelectricity by treatment of orientating molecules by drawing, there is no need to perform poling treatment unlike other piezoelectric polymers such as polyvinylidene fluoride (PVDF) or piezoelectric ceramics. The piezoelectric constant of uniaxially drawn polylactic acid is about 5 to 30 pC/N, which is a very high piezoelectric constant among polymers. Furthermore, the piezoelectric constant of polylactic acid does not vary with time and is extremely stable.

The electric field producing filament 10 is preferably a fiber having a circular cross section. The electric field producing filament 10 can be produced by, for example, a method in which a piezoelectric polymer is extrusion-molded into a fiber, a method in which a piezoelectric polymer is melt-spun into a fiber (examples thereof include a spinning-drawing method in which a spinning step and a drawing step are separately performed, a spin-draw method in which a spinning step and a drawing step are connected, a POY-DTY method in which a false twisting step can also be performed at the same time, and an ultrahigh speed spinning method in which speed is increased), a method in which a piezoelectric polymer is formed into a fiber by dry or wet spinning (examples thereof include a phase separation method or a dry-wet spinning method in which a polymer as a raw material is dissolved in a solvent and extruded from a nozzle to form a fiber, a gel spinning method in which a fiber is uniformly formed in the form of a gel while including a solvent, and a liquid crystal spinning method in which a fiber is formed using a liquid crystal solution or a melt), a method in which a piezoelectric polymer is formed into a fiber by electrostatic spinning, or the like. The cross-sectional shape of the electric field producing filament 10 is not limited to a circular shape.

Figure 2B:
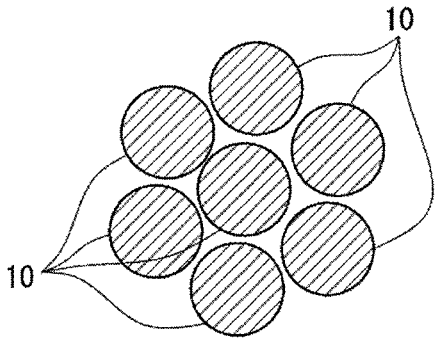
FIG. 2B is a cross-sectional view taken along the line A-A of FIG. 2A.
Figure 2C:
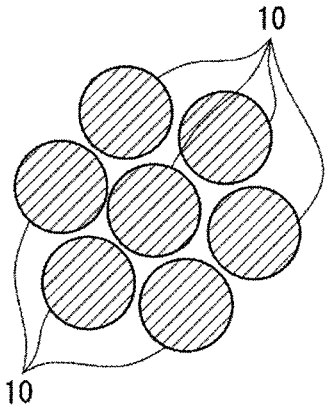
FIG. 2C is a cross-sectional view taken along the line B-B of FIG. 2A.

For example, the piezoelectric yarn 1 illustrated in FIGS. 2A to 2C may be a yarn (multifilament yarn) (S yarn) obtained by twisting a plurality of such electric field producing filaments 10 including polylactic acid (the way of twisting is not particularly limited). The drawing direction 900 of each electric field producing filament 10 coincides with the axial direction of the electric field producing filament 10. Therefore, the drawing direction 900 of the electric field producing filament 10 is inclined to the left with respect to the axial direction of the piezoelectric yarn 1. The angle depends on the number of twists.

When, for example, tension (preferably tension in the axial direction) or a stress (preferably a tensile stress in the axial direction) is applied as the "external force" to the piezoelectric yarn 1, which is the S yarn, a negative (−) charge (or potential) is produced on the surface of the piezoelectric yarn 1, and a positive (+) charge (or potential) can be produced on the inner side thereof.

The piezoelectric yarn 1 can produce an electric field by a potential difference that can be generated by the electric charges. This electric field can also leak into a space in the vicinity to form a coupled electric field with other portions. The electric potential produced in the piezoelectric yarn 1 can also produce an electric field between the piezoelectric yarn 1 and a nearby object having a predetermined electric potential, for example, an object such as a human body having a predetermined electric potential (including a ground potential), when the piezoelectric yarn 1 comes close to the object.

Figure 4A:
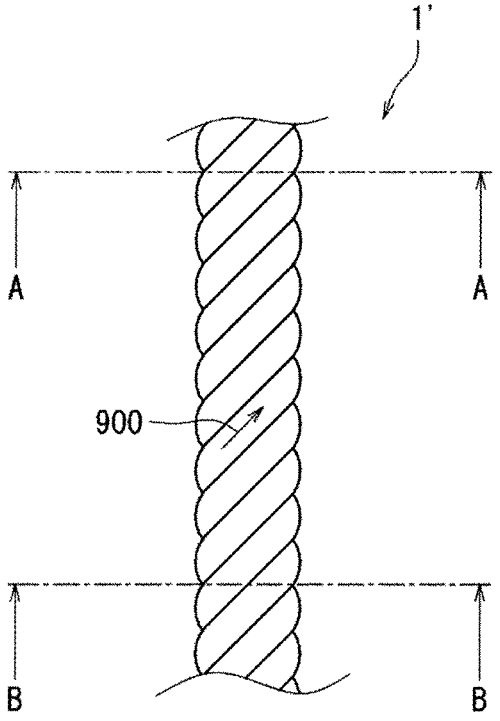
FIG. 4A shows a configuration of a yarn 1' (Z yarn)
Figure 4B:
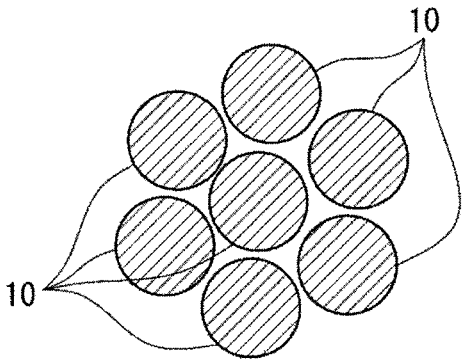
FIG. 4B is a cross-sectional view taken along the line A-A of FIG. 4A.
Figure 4C:
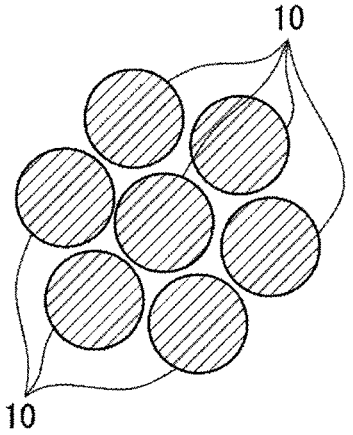
FIG. 4C is a cross-sectional view taken along the line B-B of FIG. 4A.

Next, referring to FIGS. 4A to 4C, since the piezoelectric yarn 1' is the Z yarn, the drawing direction 900 of the electric field producing filament (or piezoelectric fiber) 10 is inclined to the right with respect to the axial direction of the piezoelectric yarn 1'. The angle depends on the number of twists of the yarn.

When, for example, tension (preferably tension in the axial direction) or a stress (preferably a tensile stress in the axial direction) is applied as the "external force" to the piezoelectric yarn 1', which is the Z yarn, a positive (+) charge (or potential) is produced on the surface of the piezoelectric yarn 1', and a negative (−) charge (or potential) can be produced on the inner side thereof.

The piezoelectric yarn 1' can also produce an electric field by a potential difference that can be generated by the electric charges. This electric field can also leak into a space in the vicinity to form a coupled electric field with other portions. The electric potential produced in the piezoelectric yarn 1' can also produce an electric field between the piezoelectric yarn 1' and a nearby object having a predetermined electric potential, for example, an object such as a human body having a predetermined electric potential (including a ground potential), when the piezoelectric yarn 1' comes close to the object.

Furthermore, when the piezoelectric yarn 1, which is the S yarn, and the piezoelectric yarn 1', which is the Z yarn, are brought close to each other, an electric field can be produced between the piezoelectric yarn 1 and the piezoelectric yarn 1'.

The polarities of electric charges (or electric potentials) produced in the piezoelectric yarn 1 and the piezoelectric yarn 1' are different from each other. The potential difference at each position can be defined by an electric field coupling circuit that can be produced by complicated entanglement of fibers or a circuit that can be formed by a current path that can be accidentally formed in the yarn with moisture or the like.

The piezoelectric yarn 1 and the piezoelectric yarn 1' can be understood more deeply by reading JP-B-6428979. JP-B-6428979 is incorporated herein by reference.

In the piezoelectric yarn 1, the electric field producing filament 10 is preferably constituted of polylactic acid (PLA). With the electric field producing filament 10 including a piezoelectric material such as polylactic acid, the surface potential can be more appropriately controlled. In addition, since polylactic acid is hydrophobic, it is possible to provide a smooth and dry touch, and thereby it is also possible to impart comfort to the knitted structure. In addition, since polylactic acid is known as a biodegradable plastic, it can be finally decomposed into $CO_2$ and water, and the load on the environment can be reduced.

The degree of crystallization of "polylactic acid" is, for example, preferably 20% or more, preferably 30% or more, more preferably 40% or more, still more preferably 50% or more, particularly preferably 55% or more. The degree of crystallization can be determined by a measurement method such as differential scanning calorimetry (DSC), X-ray diffraction (XRD), and wide angle X-ray diffraction (WAXD). Within such a range, the piezoelectricity derived from the polylactic acid crystal increases, and polarization due to the piezoelectricity of polylactic acid can be more effectively caused. In the present disclosure, it has been found that the measured value of the degree of crystallization measured using WAXD and the measured value of the degree of crystallization measured using DSC are different by about 1.5 times (DSC measured value/WAXD measured value=1.5).

In the piezoelectric yarn 1, additives such as a plasticizer and a lubricant are not included. In general, it is known that when the piezoelectric yarn 1 includes an additive, a surface potential tends to be hardly produced. Therefore, in order to appropriately produce the surface potential, it is preferable that the piezoelectric yarn 1 does not include an additive. The "plasticizer" in the present disclosure is a material for imparting flexibility to the piezoelectric yarn 1, and the "lubricant" is a material for improving molecular slippage of the piezoelectric yarn 1. Specifically, polyethylene glycol, castor oil-based fatty acid esters, polyoxyethylene sorbitan fatty acid esters, polyethylene glycol fatty acid esters, stearic acid amide, glycerin fatty acid esters, and the like are intended. These materials are not included in the piezoelectric yarn 1 of the present disclosure.

The piezoelectric yarn 1 should not be construed as being limited to the above aspects, particularly the yarns that can be constituted of polylactic acid. The method for producing the piezoelectric yarn 1 is also not particularly limited and is not limited to the above production method.

Other Aspects of Piezoelectric Yarn

Furthermore, the piezoelectric yarn 1 may be provided with a "dielectric" around the electric field producing filaments 10. For example, as schematically illustrated in the cross-sectional view of FIG. 5, a dielectric 100 can be provided around the electric field producing filaments (or piezoelectric fibers) 10.

In the present disclosure, the term "dielectric" means a member including material or a substance having "dielectric properties" (a property of being electrically polarized (or subjected to dielectric polarization or electric polarization) in positive and negative by an electric field), and electric charges can be accumulated on a surface thereof.

The dielectric 100 may be present in the longitudinal axis direction and the circumferential direction of the electric field producing filaments 10 and may completely or partially cover the electric field producing filaments. When the dielectric 100 partially covers the electric field producing filaments 10, the electric field producing filaments 10 themselves may be directly exposed in the uncovered portion.

Therefore, the dielectric 100 may be provided entirely or partially in the longitudinal axis direction of the electric field producing filaments 10. In addition, the dielectric 100 may be provided entirely or partially in the circumferential direction of the electric field producing filaments 10.

Figure 5:
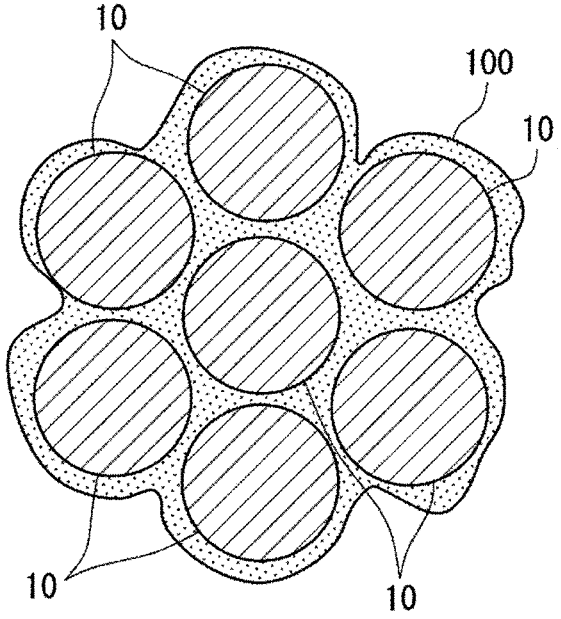
FIG. 5 is a cross-sectional view schematically showing a cross section of a yarn comprising a dielectric around electric field producing filaments.

Further, the thickness of the dielectric 100 may be uniform or non-uniform (see, for example, FIG. 5).

The dielectric 100 may be present between a plurality of electric field producing filaments 10, and in this case, there may be a portion where the dielectric 100 is not present between the electric field producing filaments 10. In addition, bubbles or cavities may be present in the dielectric 100.

The dielectric 100 is not particularly limited as long as it includes a dielectric material or substance. As the dielectric 100, a dielectric material (such as an oil and an antistatic agent) known to be able to be used as a surface treatment agent (or a fiber treatment agent) mainly in the fiber industry may be used.

In the piezoelectric yarn 1, the dielectric 100 preferably includes an oil. As the oil, an oil (yarn making oil) used as a surface treatment agent (or fiber treatment agent) that can be used in the production of the electric field producing filaments 10 can be used (for example, anionic, cationic, or nonionic surfactants and the like). In addition, an oil (such as an anionic, cationic, or nonionic surfactant or the like) used as a surface treatment agent (or fiber treatment agent) that can be used in the step of producing cloth (such as knitting and weaving), and an oil (such as an anionic, cationic, or nonionic surfactant or the like) used as a surface treatment agent (or fiber treatment agent) that can be used in the finishing step can also be used. Here, as representative examples, a filament production step, a cloth production step, a finishing step, and the like have been described, but these steps are not limiting. As the oil, in particular, an oil used for reducing friction of the electric field producing filaments 10 or the like is preferably used.

Examples of the oil include DELION series manufactured by TAKEMOTO OIL & FAT Co., Ltd., MARPOZOL series and MARPOSIZE series manufactured by Matsumoto Yushi-Seiyaku Co., Ltd., and PARATEX series manufactured by Marubishi Oil Chemical Co., Ltd.

The oil may be present entirely or at least partially along the electric field producing filaments 10. After the electric field producing filaments 10 are processed into the piezoelectric yarn 1, at least a part or all of the oil may fall off from the electric field producing filaments 10 by washing.

In addition, the dielectric 100 used to reduce friction of the electric field producing filaments 10 may be a surfactant such as a detergent or a softener used at the time of washing.

Examples of the detergent include Attack (registered trademark) series manufactured by Kao Corporation, TOP (registered trademark) series manufactured by Lion Corporation, and ARIEL (registered trademark) series manufactured by Proctor and Gamble Japan K.K.

Examples of the softener include Humming (registered trademark) series manufactured by Kao Corporation, SOFLAN (registered trademark) series manufactured by Lion Corporation, and LENOR (registered trademark) series manufactured by Proctor and Gamble Japan K.K.

The dielectric 100 may have conductivity (property of conducting electricity), and in this case, the dielectric 100 preferably includes an antistatic agent. As the antistatic agent, an antistatic agent used as a surface treatment agent (or a fiber treatment agent) that can be used in the production of the electric field producing filaments 10 and the like can be used. As the antistatic agent, in particular, an antistatic agent used for reducing unraveling of the electric field producing filaments 10 or the like is preferably used.

Examples of the antistatic agent include Capron series manufactured by Nissin Kagaku Kenkyusho Co., Ltd. and NICEPOLE series and DEATRON series manufactured by Nicca Chemical Co., Ltd.

The antistatic agent may be present entirely or at least partially along the electric field producing filaments 10. After the electric field producing filaments 10 are processed into the piezoelectric yarn 1, at least a part or all of the antistatic agent may fall off from the electric field producing filaments 10 by washing.

In addition, the above-described surface treatment agent (or fiber treatment agent) such as the oil and the antistatic agent, detergent, softener, and the like may not be present around the electric field producing filaments 10. That is, the electric field producing filaments 10 or the piezoelectric yarn 1 may not include the above-described surface treatment agent (or fiber treatment agent) such as the oil and the antistatic agent, detergent, softener, or the like. In that case, the air (or air layer) present between the electric field producing filaments 10 can function as a dielectric. Therefore, in this case, the dielectric includes air.

For example, the piezoelectric yarn 1 not including the above-described surface treatment agent (or fiber treatment agent), detergent, softener, or the like may be used, the piezoelectric yarn 1 being obtained by subjecting a yarn provided with the above-described surface treatment agent (or fiber treatment agent) such as the oil and the antistatic agent, detergent, softener, or the like adhering around the electric field producing filaments 10 to a treatment such as washing and solvent immersion. In that case, pure electric field producing filaments 10 are exposed. Alternatively, in the present disclosure, a piezoelectric yarn 1 consisting of the pure electric field producing filaments 10 may be used.

Furthermore, in the present disclosure, for example, a yarn in which the above-described surface treatment agent (or fiber treatment agent) such as the oil and the antistatic agent, detergent, softener, and the like are partially removed by treatment such as washing and solvent immersion and in which the pure electric field producing filaments 10 are partially exposed may be used.

The thickness of the dielectric 100 (or the interval between the electric field producing filaments 10) is about 0 μm to about 10 μm, preferably about 0.5 μm to about 10 μm, more preferably about 2.0 μm to about 10 μm, and is generally about 5 μm.

Elastic Yarn

Next, the elastic yarn 2 will be described. The elastic yarn is intended to mean a yarn having stretchability, and the term "stretchability" as used in the present specification means that the elastic recovery percentage of elongation is 40% or more. The elastic recovery percentage of elongation is a value measured in accordance with "JIS L 1096 Testing methods for woven and knitted fabrics" and is 100% when the length has returned to the original length and 0% when the elongated length is maintained. The "stretchability" may be determined, for example, on the basis of a test method such as "JIS L 1096 Testing methods for woven and knitted fabrics". Here, in the case of the knitted fabric structure consisting of the piezoelectric yarn 1 described above, the stretchability is poor, and the wearing comfort at the time of wearing is deteriorated. Therefore, the knitted fabric structure includes the elastic yarn 2 in addition to the piezoelectric yarn 1 (see FIG. 1).

Preferable examples of the elastic yarn 2 include any yarn selected from the group consisting of a yarn using polyurethane, a nylon yarn subjected to woolly finish, and polytrimethylene terephthalate as a core yarn.

The dimension (length, thickness (diameter), and the like) and the shape (cross-sectional shape and the like) of the electric yarn 2 are not particularly limited. The elastic yarn 2 may be made of filaments or staple fibers.

Thus, when the elastic yarn 2 is included in the knitted fabric structure of the present disclosure, the stretchability of the knitted fabric structure is secured, and the wearing comfort at the time of wearing is improved. In addition, since the fabric itself has stretchability, the piezoelectric yarn 1 also stretches following the stretch of the elastic yarn 2. Thus, since an energy (external force) is applied to the piezoelectric yarn 1, a surface potential can be produced in the knitted fabric structure.

Other Additional Configurations

The knitted fabric structure of the present disclosure may include yarns made of natural fibers and/or chemical fibers in addition to the piezoelectric yarn 1 and the elastic yarn 2 described above. Examples of the natural fibers include cotton, silk, hemp, and/or wool, and the inclusion of these natural fibers provides good touch and/or wearing comfort and improves hygroscopicity and air permeability. Examples of the chemical fibers include nylon, acrylic, and/or rayon, and the inclusion of these chemical fibers can improve the durability of the knitted fabric structure.

Mixing Ratio in Knitted Fabric Structure

In the knitted structure of the present disclosure including the above-described piezoelectric yarn 1 and elastic yarn 2, the mixing ratio of the piezoelectric yarn 1 is 5% or more on the basis of the entire knitted fabric structure. Within such a numerical range, microbes and viruses can be appropriately suppressed. The basis for the numerical range will be described in detail in examples to be described later.

Further, as an aspect of the knitted fabric structure A of the present disclosure, the ratio of the piezoelectric yarn 1 is preferably 65% or less on the basis of the entire knitted fabric structure. In other words, the ratio of a yarn (such as the elastic yarn 2 and a yarn of cotton or the like) other than the piezoelectric yarn 1 is preferably 35% or more on the basis of the entire knitted fabric structure A. When at least about 35% of the yarn other than the piezoelectric yarn 1 is included, the stretchability of the knitted fabric structure A is secured as compared with a knitted fabric structure consisting of the piezoelectric yarn, and the wearing comfort of the knitted fabric structure A at the time of wearing can be improved.

Specific Form of Knitted Fabric Structure

Figure 6A:
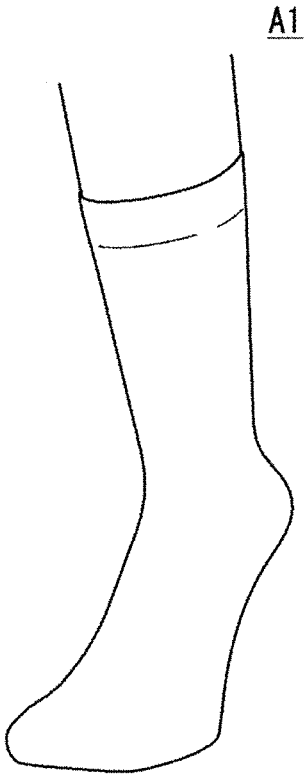
FIG. 6A schematically shows a socks using the knitted fabric structure of the present disclosure, and FIG. 6B schematically shows a sole of the socks using the knitted fabric structure of the present disclosure.
Figure 6B:
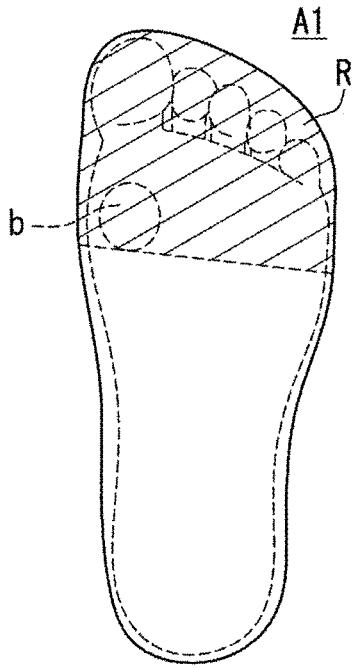
Figure 7:
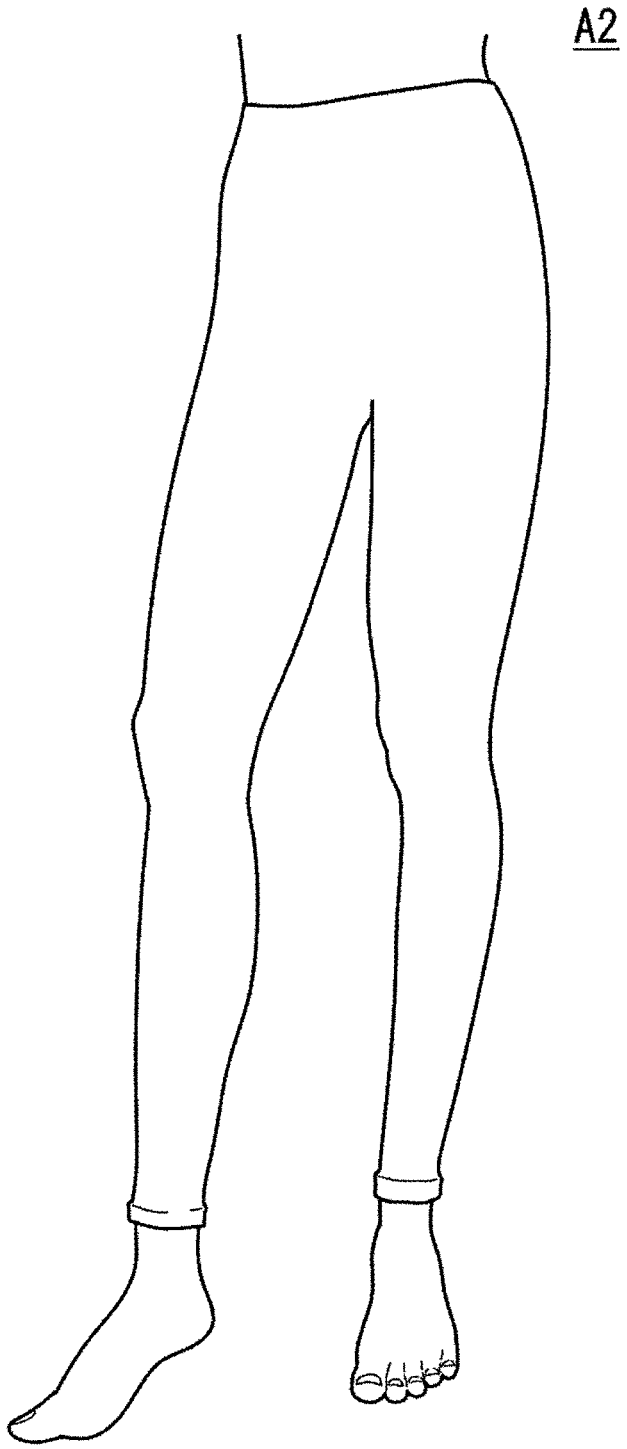
FIG. 7 schematically shows leggings using the knitted fabric structure of the present disclosure.
Figure 8:
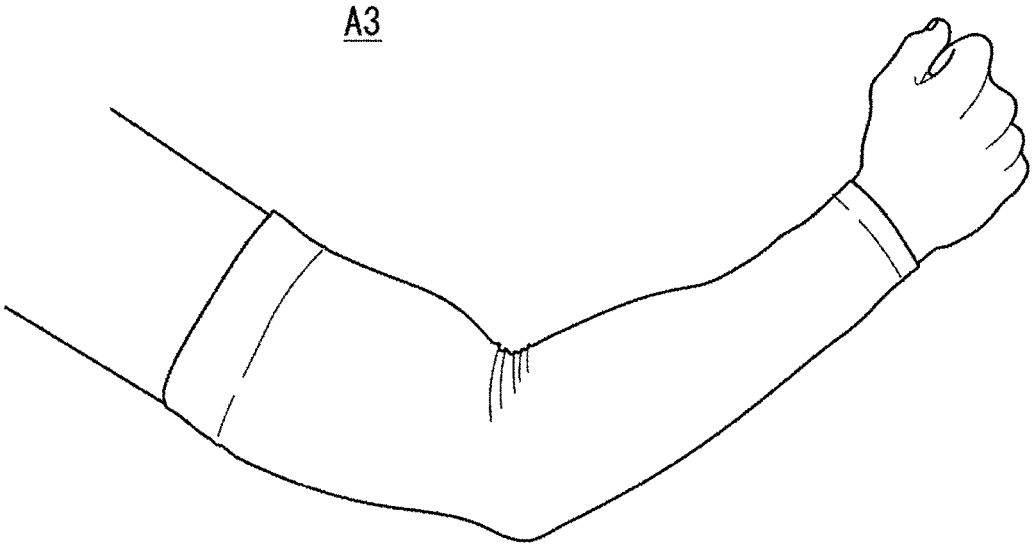
FIG. 8 schematically shows an arm cover using the knitted fabric structure of the present disclosure.
Figure 9:
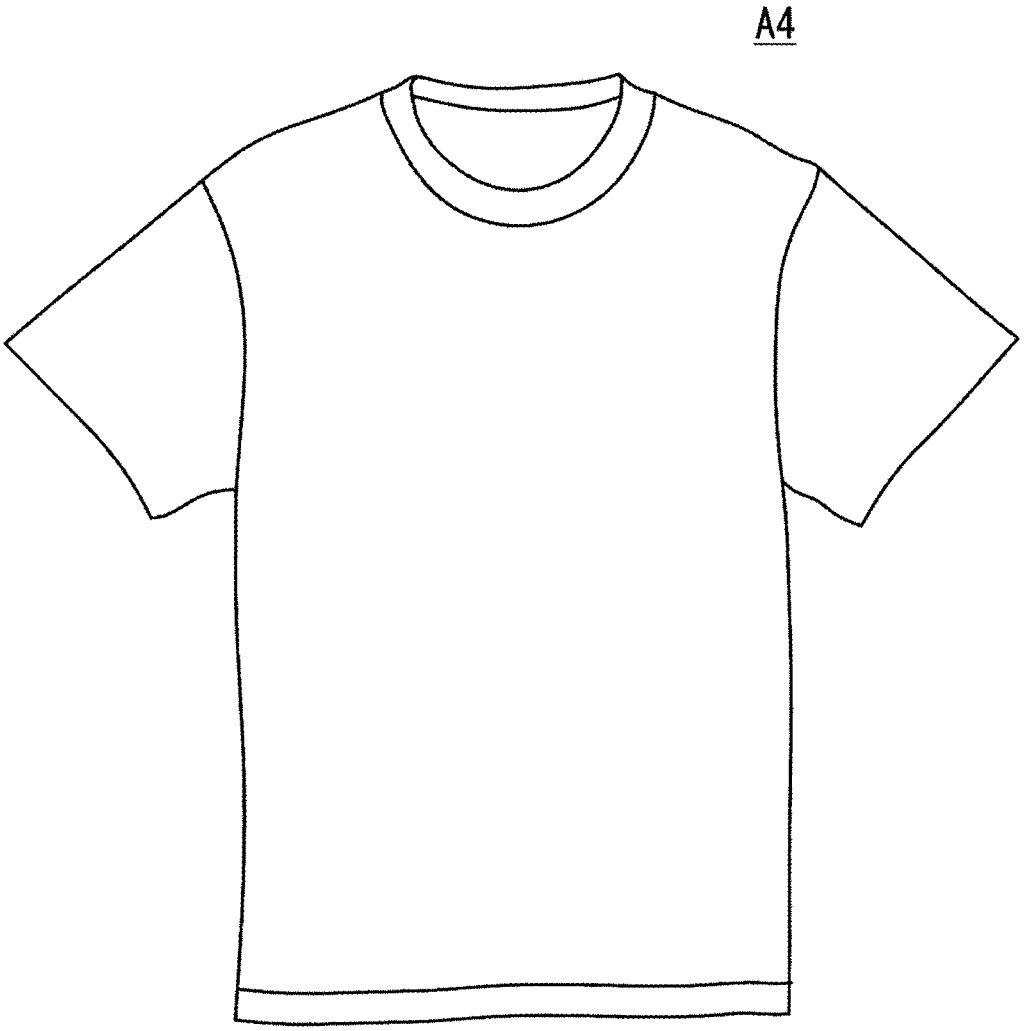
FIG. 9 schematically shows a shirt using the knitted fabric structure of the present disclosure.

Next, a specific form of the knitted fabric structure of the present disclosure will be described. The knitted fabric structure of the present disclosure may be used in a form selected from the group consisting of a socks (see FIGS. 6A and 6B), leggings (see FIG. 7), an arm cover (see FIG. 8) and a shirt (FIG. 9).

As a preferable aspect of the knitted fabric structure, the piezoelectric yarn 1 may be arranged at a position where the knitted fabric structure is subjected to stretching. For example, the piezoelectric yarn 1 may be arranged at a position where the knitted fabric structure is subjected to stretching during the wearing of the knitted fabric structure. The term "during the wearing of the knitted fabric structure" means that "at a point in time when or after someone put on the knitted fabric structure." Arranging the piezoelectric yarn 1 in this manner facilitates stretch of the piezoelectric yarn 1 and production of a surface potential. Therefore, microbes and viruses can be suppressed by production of the surface potential. Next, a specific knitted fabric structure will be described.

1. Socks

In the case where the knitted fabric structure is a socks (see FIGS. 6A and 6B), the piezoelectric yarn 1 can stretch when the base of the toe is bent by movement during walking. Therefore, the "socks" as used in the present specification is intended to be a bag-shaped cloth covering the foot or the foot and the lower limb (lower leg and thigh). Examples of the socks include socks, stockings (such as garter stocking and stay-ups), and pantyhose. Furthermore, socks also include those having various lengths such as no-show socks (pump socks) such as low-cut no-show socks and high-cut no-show socks, anklets, crew socks, knee-high socks, and over the knee socks. In addition, a five-toe sock in which the toe portion is branched for five fingers and a two-toe socks in which the toe portion is divided into two are also included.

As a preferable aspect of the socks, the piezoelectric yarn 1 is preferably arranged in a region R (see FIG. 6B) on the toe side of a ball of the foot b in order to cause the piezoelectric yarn 1 to stretch by movement during walking to produce a surface potential. With this arrangement of the piezoelectric yarn 1, microbes and viruses can be appropriately suppressed by production of the surface potential.

2. Leggings

In the case where the knitted fabric structure is leggings (see FIG. 7), the piezoelectric yarn 1 can stretch when the hip joint and/or the knee joint are bent by movement during walking. Therefore, the term "leggings" as used in the present specification is intended to be a wearing object that covers the hip joint and/or the knee joint. Note that the term "leggings" used in the present specification is intended to be a wearing object that stretches by movement of at least the hip joint or the knee joint and thus includes a wearing object whose length reaches a position above the knee joint, such as compression shorts and underpants, leg warmers that stretch by movement of the knee joint, and the like.

As a preferable aspect of the leggings, the piezoelectric yarn 1 is preferably arranged in regions on the hip joint and/or the knee joint in order to cause the piezoelectric yarn 1 to stretch by movement during walking to produce a surface potential. With this arrangement of the piezoelectric yarn 1, microbes and viruses can be appropriately suppressed by production of the surface potential.

3. Arm Cover

In the case where the knitted fabric structure is an arm cover (see FIG. 8), the piezoelectric yarn 1 can stretch by movement of the arm (motion of the elbow joint, shoulder joint, and/or wrist). Therefore, the term "arm cover" as used in the present specification is intended to be a wearing object that covers the elbow joint, the shoulder joint, and/or the wrist. Note that the term "arm cover" used in the present specification is intended to be a wearing object that stretches by movement of at least the elbow joint, the shoulder joint, and/or the wrist and thus includes, for example, gloves and the like.

As a preferable aspect of the arm cover, the piezoelectric yarn 1 is preferably arranged in regions on the elbow joint, the shoulder joint, and/or the wrist in order to cause the piezoelectric yarn 1 to stretch by movement during walking to produce a surface potential. With this arrangement of the piezoelectric yarn 1, microbes and viruses can be appropriately suppressed by production of the surface potential.

4. Shirt

In the case where the knitted fabric structure is a shirt (see FIG. 9), the piezoelectric yarn 1 can stretch by movement of the upper body. Therefore, the term "shirt" used in the present specification is intended to be a wearing object that can be worn on the upper body. For example, since the armpit easily sweats, microbes easily propagate in the armpit portion of the shirt, and it is preferable to provide the piezoelectric yarn 1 in that portion. With this arrangement of the piezoelectric yarn 1, microbes and viruses can be appropriately suppressed by production of the surface potential. The arrangement of the piezoelectric yarn 1 is not limited to the armpit portion and may be provided at a portion where the shirt stretches by the motion of the upper body, such as a back portion, a waist portion, a knee portion, a wrist portion, a neck portion, a chest portion, and/or a belly portion.

EXAMPLES

With respect to the knitted fabric structure of the present disclosure, a demonstration test on the microbe suppressing effect was performed.

Examples for Socks

As knitted fabric structures, socks described in Examples 1 to 5 and a Comparative example shown in [Table 1] below were produced.

TABLE 1

| | Comparative example | Example 1 | Example 2 | Example 3 | Example 4 | Example 5 |
|---|---|---|---|---|---|---|
| Piezoelectric yarn | None | Polylactic acid | Polylactic acid | Polylactic acid | Polylactic acid | Polylactic acid |
| Elastic yarn | FTY 10% | FTY 5% | FTY ~10% | FTY 26% | FTY 25% | FTY 40% |
| Other yarn | Cotton 90% | Cotton 90% | Cotton 80%~ | Cotton Nylon 53% | Acrylic Rayon Wool 40% | None |
| Mixing ratio of piezoelectric yarn | 0% | 5% | ~10% | 21% | 35% | 60% |

In the table, "FTY (filament twisted yarn)" refers to a textured yarn obtained by winding a filament yarn of nylon or the like around a stretchable polyurethane elastic yarn.

In the demonstration test, first, the stretchability of the socks of the Comparative example and Examples 1 to 5 was evaluated. The total of the "stretch ratio when a socks was worn" and the "stretch ratio during walking with a socks being worn" with respect to the longitudinal direction of the sole was taken as the stretchability. The "stretch ratio when a socks was worn" was about 15%, and the "stretch ratio during walking with a socks being worn" was about 35%. That is, it was found that the total stretch ratio of the socks with respect to the longitudinal direction of the sole was about 50%(15%+30%+error).

Figure 10:
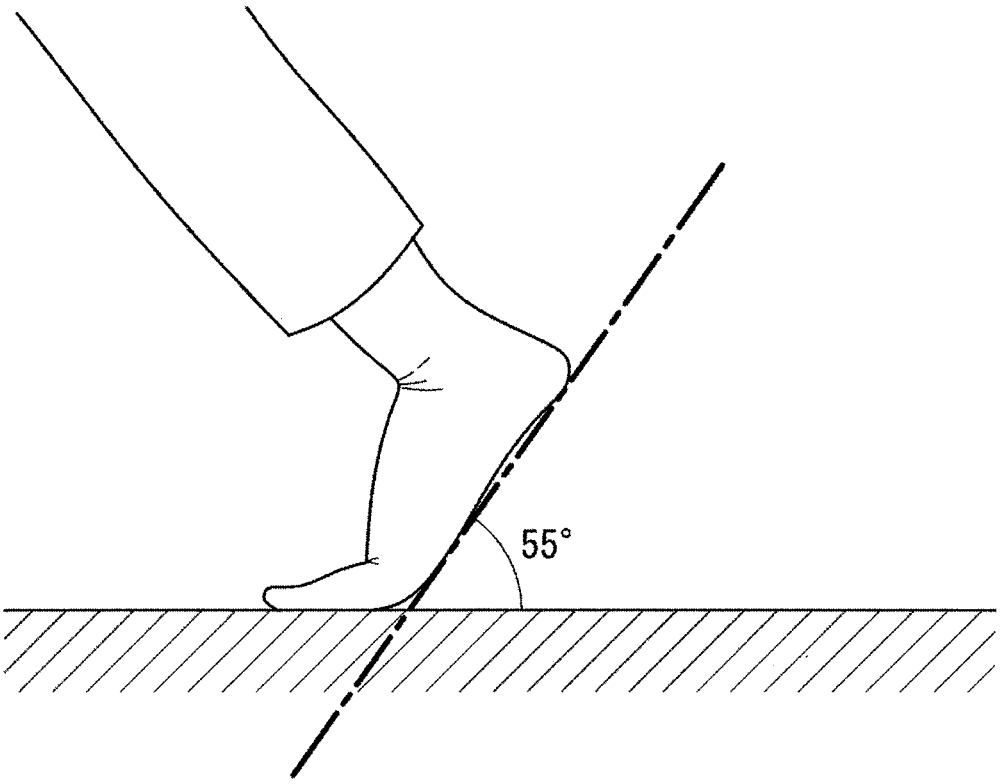
FIG. 10 schematically shows a method for evaluating stretchability of the knitted fabric structure of the present disclosure.

Note that the evaluation of stretchability was calculated to be about 15% from the result of image analysis of image data of a state in which the socks was worn by a mannequin (foot length: 24 to 27 cm, foot width: 9.1 to 9.7 cm, instep girth: 23 to 25 cm, ball girth: 23 to 25 cm) using a non-contact optical three-dimensional strain measurement system (3D system solution "ARAMIS" manufactured by GOM GmbH). Furthermore, in the measurement of the "stretch ratio during walking with a socks being worn", as shown in FIG. 10, it was known in advance that the angle between the foot and the floor is about 55° with the base of the toe being bent during walking. Therefore, the stretch ratio was calculated to be about 30% from the result of image analysis of the image data of the state in which the mannequin wearing the socks was caused to walk.

In addition, since the result that the total stretch ratio of the socks was about 50% was obtained from the evaluation of the stretchability, the surface potential of the socks at that stretch ratio was measured. The evaluation results are shown in [Table 2]. For the evaluation of the surface potential, a method using a potential measurement device described in Japanese Patent Application No. 2021-065673 (Corresponds to WO2022/215672 A1) was adopted.

TABLE 2

| | Comparative example | Example 1 | Example 2 | Example 3 | Example 4 | Example 5 |
|---|---|---|---|---|---|---|
| Surface potential | 0 V | >0.1 V | 0.5 V | 2.2 V | 3.4 V | 8.4 V |

Surface Potential for Socks with Stretching Ratio of About 50%

As described above, according to the results in Table 2, the socks of Examples 1 to 5 showed surface potentials of 0.1 V or more. On the other hand, in the socks of the Comparative example, since the piezoelectric yarn 1 was not included, a result was obtained in which no surface potential was produced.

Next, the socks of the Comparative example and Examples 1 to 5 were subjected to an antibacterial test. The content of the antibacterial test is as follows.

(1) The viable cell counts are measured for the socks of the Comparative example and Examples 1 to 5 in the initial state.

(2) The viable cell counts after allowing the socks of the Comparative example and Examples 1 to 5 to stand for 18 hours are measured.

(3) For the socks of the Comparative example and Examples 1 to 5 that were allowed to stand for 18 hours, the viable cell counts after the socks were continuously stretched for 18 hours to produce surface potentials are measured.

The viable cell counts were evaluated on the basis of the method of JIS L 1902 as described in JP-B-6922546 and JP-B-6292368. The measurement results of the viable cell counts are shown in [Table 3]. The numerical values in the table indicate logarithms (logarithm of the number of colonies per 1 g) of the numbers of colony forming units.

TABLE 3

| | Comparative example | Example 1 | Example 2 | Example 3 | Example 4 | Example 5 |
|---|---|---|---|---|---|---|
| Initial viable cell count (T1) | 5.50 | 5.86 | 5.81 | 5.07 | 5.03 | 5.76 |
| Viable cell count (T2) after standing for 18 hours | 8.50 | 8.64 | 8.96 | 8.58 | 8.08 | 8.87 |
| Viable cell count (T3) after stretching for 18 hours | 8.20 | 6.59 | 6.76 | 5.53 | 3.77 | 2.92 |
| T2-T1 | +3.00 | +2.78 | +3.15 | +3.51 | +3.05 | +3.11 |
| T3-T2 | +2.70 | −2.05 | −2.20 | −3.05 | −4.31 | −5.95 |

According to the results in Table 3, in the socks of Examples 1 to 5, the difference between the viable cell count (T3) after stretching for 18 hours and the viable cell count (T2) after standing for 18 hours was-2 or more, and the result that the number of microbes was effectively reduced was obtained, whereas in the socks of the Comparative example, the number of microbes was increased. Thus, it was possible to suppress proliferation of microbes by stretching the piezoelectric yarn 1 to produce a surface potential.

Examples for Leggings

Leggings described in Examples 6 and 7 shown in [Table 4] below were produced as knitted fabric structures, and the antibacterial test described above was carried out. Unlike the stretch ratio (about 50%) of the socks, the stretch ratio of the leggings was set to 39%. This is attributable to the difference between the motion of the toe in the case of socks and the motion of the knee joint or the hip joint in the case of leggings.

TABLE 4

| | Example 6 | Example 7 |
|---|---|---|
| Piezoelectric yarn (back yarn) | Polylactic acid | Polylactic acid |
| Elastic yarn (inserted yarn) | DCY 5% | DCY 5% |
| Other yarn (front yarn) | Cotton 72% | Cotton 62% |
| Mixing ratio of piezoelectric yarn | 23% | 33% |
| T3-T2 | −2.5 | −3.0 |

In the table, "DCY (double covered yarn)" means a textured yarn obtained by doubly winding other spun yarns and filament yarns around a polyurethane elastic yarn in different directions to each other. The "front yarn" in the table is intended to be a yarn exposed to the front surface of a woven fabric, the "back yarn" is intended to be a yarn exposed to the back surface of the woven fabric, and the "inserted yarn" is intended to be a yarn arranged between the front yarn and the back yarn and inserted into a loop of the front yarn and a loop of the back yarn.

According to the results of T3-T2 in the results in Table 4, the results in which microbes were effectively reduced were obtained for the leggings of Examples 6 and 7.

Example for Arm Cover

An arm cover described in Example 8 shown in [Table 5] below was produced as a knitted fabric structure, and the antibacterial test described above was carried out. Unlike the stretch ratio (about 50%) of the socks, the stretch ratio of the arm cover was set to 45%. This is attributable to the difference between the motion of the toe in the case of socks and the motion of the elbow joint in the case of an arm cover.

TABLE 5

| | Example 8 |
|---|---|
| Piezoelectric yarn (back yarn) | Polylactic acid |
| Elastic yarn (front yarn) | Woolly nylon 44% |
| Mixing ratio of piezoelectric yarn | 56% |
| T3-T2 | −4.9 |

According to the result of T3-T2 in the results in Table 5, the results in which microbes were effectively reduced were obtained for the arm cover of Example 8.

Examples for Shirt

Shirts described in Examples 9 to 11 shown in [Table 6] below were produced as knitted fabric structures, and the antibacterial test described above was carried out. Unlike the stretch ratio (about 50%) of the socks, the stretch ratio of the shirts was set to 17%. This is attributable to the difference between the motion of the toe in the case of socks and the motion of the shoulder joint in the case of a shirt.

TABLE 6

| | Example 9 | Example 10 | Example 11 |
|---|---|---|---|
| Piezoelectric yarn (back yarn) | Polylactic acid | Polylactic acid | Polylactic acid |
| Elastic yarn (front yarn) | PTT 50% | PTT 39% | PTT 36% |
| Mixing ratio of piezoelectric yarn | 50% | 61% | 64% |
| T3-T2 | −3.02 | −2.41 | −3.33 |

In the table, "PTT (polytrimethylene terephthalate)" is intended to be a yarn made of polytrimethylene terephthalate, which is a kind of stretchable polyester.

According to the results of T3-T2 in the results in Table 6, the results in which microbes were effectively reduced were obtained for the shirts of Examples 9 to 11.

Note that the embodiments disclosed herein are illustrative in all respects and do not provide a basis for restrictive interpretation. Therefore, the technical scope of the present invention is not to be construed only by the above-described embodiments but is defined on the basis of the description of the claims. In addition, the technical scope of the present invention includes all modifications within the meanings and scope equivalent to the claims.

What is claimed is:

1. A knitted fabric structure comprising:

a piezoelectric yarn comprising polylactic acid as a piezoelectric material and that produces a surface potential by input of an external force from an outside of the piezoelectric yarn, the piezoelectric yarn having a first loop; wherein the first loop does not include an elastic yarn; and an elastic yarn having an elongation recovery rate of 40% or more, the elastic yarn having a second loop, wherein the second loop of the elastic yarn is hooked to the first loop of the piezoelectric yarn, wherein the piezoelectric yarn has a mixing ratio of 5% or more based on a whole of the knitted fabric structure, and wherein the elastic yarn has a mixing ratio of 35% or more based on the whole of the knitted fabric structure.

2. The knitted fabric structure according to claim 1, wherein the piezoelectric material is in the form of electric field producing filaments.

3. The knitted fabric structure according to claim 2, wherein a number of the electric field producing filaments in the piezoelectric yarn is 2 or more.

4. The knitted fabric structure according to claim 2, wherein the electric field producing filaments are in a twisted form in the piezoelectric yarn.

5. The knitted fabric structure according to claim 2, further comprising a dielectric around the electric field producing filaments.

6. The knitted fabric structure according to claim 1, wherein the mixing ratio of the piezoelectric yarn is 65% or less based on the whole of the knitted fabric structure.

7. The knitted fabric structure according to claim 1, wherein the elastic yarn is one selected from the group consisting of a yarn containing polyurethane, a nylon yarn having a woolly finish, and polytrimethylene terephthalate as a core yarn.

8. The knitted fabric structure according to claim 1, wherein a degree of crystallization of the polylactic acid is 20% or more.

9. The knitted fabric structure according to claim 1, wherein the piezoelectric material does not comprise an additive.

10. The knitted fabric structure according to claim 1, wherein the surface potential is 0.1V or more.

11. The knitted fabric structure according to claim 1, wherein a fiber strength of the piezoelectric yarn is 1 to 10 cN/dtex.

12. The knitted fabric structure according to claim 1, wherein the piezoelectric yarn is arranged at a position where the knitted fabric structure is subjected to stretching during the wearing of the knitted fabric structure.

13. The knitted fabric structure according to claim 12, wherein the position where the knitted fabric structure is subjected to stretching during the wearing of the knitted fabric structure is on a toe side of a ball of a foot.

14. A sock comprising the knitted fabric structure according to claim 1.

15. A leggings comprising the knitted fabric structure according to claim 1.

16. An arm cover comprising the knitted fabric structure according to claim 1.

17. A shirt comprising the knitted fabric structure according to claim 1.

* * * * *